US007475564B2

(12) United States Patent
Kagen

(10) Patent No.: US 7,475,564 B2
(45) Date of Patent: Jan. 13, 2009

(54) CONTAINER WITH SEALED COOLANT COMPARTMENT

(76) Inventor: Kristin W. Kagen, 9 Cobham Draw, Pooler, GA (US) 31322

( * ) Notice: Subject to any disclaimer, the term of this patent is extended or adjusted under 35 U.S.C. 154(b) by 37 days.

(21) Appl. No.: 11/541,702

(22) Filed: Oct. 3, 2006

(65) Prior Publication Data

US 2007/0074532 A1 Apr. 5, 2007

Related U.S. Application Data

(60) Provisional application No. 60/722,434, filed on Oct. 3, 2005.

(51) Int. Cl.
*F25D 3/08* (2006.01)

(52) U.S. Cl. ..... 62/457.2

(58) Field of Classification Search ..... 62/457.2, 62/457.7, 371, 265

See application file for complete search history.

(56) References Cited

U.S. PATENT DOCUMENTS 4,167,228 A 9/1979 Cheetham
4,277,000 A 7/1981 Jaarsma
4,294,351 A 10/1981 Cheetham
5,004,106 A 4/1991 Blumstock et al.
5,699,957 A 12/1997 Blin et al.
5,921,440 A 7/1999 Maines
6,036,044 A 3/2000 Parker et al.
6,050,442 A 4/2000 Wysocki
6,212,901 B1 * 4/2001 Pint et al. ..... 62/457.7
6,295,830 B1 10/2001 Newman
6,601,403 B1 8/2003 Roth et al.
6,609,392 B1 * 8/2003 Brown ..... 62/457.1
6,959,807 B2 11/2005 Sharon et al.
7,083,043 B2 8/2006 Sharon
7,156,226 B1 1/2007 Van Sickle

* cited by examiner

*Primary Examiner*—Melvin Jones
(74) *Attorney, Agent, or Firm*—Nixon & Vanderhye P.C.

(57) ABSTRACT

A container includes a primary compartment and a secondary compartment generally evenly opposed to and oppositely facing from the primary compartment. A lid is provided for each of the primary compartment and the secondary compartment. In use, the primary compartment is suited for storing food items and the like, and the secondary compartment is suited for storing a coolant such as an ice pack or the like.

9 Claims, 1 Drawing Sheet

CONTAINER WITH SEALED COOLANT COMPARTMENT

CROSS-REFERENCES TO RELATED APPLICATIONS

This application claims the benefit of U.S. Provisional Patent Application Ser. No. 60/722,434, filed Oct. 3, 2005, the entire content of which is herein incorporated by reference.

STATEMENT REGARDING FEDERALLY SPONSORED RESEARCH OR DEVELOPMENT (NOT APPLICABLE)

BACKGROUND OF THE INVENTION

There are many plastic containers for storing and transporting food and related items. The containers typically include a lid or other closure to effect an air tight environment. There also exist such containers with multiple compartments to keep items separated or to house a coolant or the like.

Existing plastic containers, however, are not typically formed of disposable materials, particularly those with multiple compartments due to the complexity of forming a multi-compartment mold. As such, if a plastic container is used to carry food items to work or school, it is necessary to bring home the container at the end of the day, which becomes burdensome, particularly for school age children.

Additionally, most such containers do not include space for a coolant such as an ice pack or the like, and when an ice pack or coolant is placed in the same container, there is a chance that the food items may get damp. In the containers with multiple compartments, the separate compartments can keep the coolant separate from the food items, but the coolant is typically placed toward the side or rear of the container and does not provide even cooling of the food items.

BRIEF SUMMARY OF THE INVENTION

It would thus be desirable for a plastic container to include a primary compartment for storing food items and the like and a secondary compartment generally evenly opposed to and oppositely facing from the primary compartment for storing a coolant such as an ice pack or the like. Preferably, the plastic material of the container is of a type that would be considered disposable, and users would not have to remember to bring the container home at the end of the day. Additionally, since the secondary compartment is generally evenly opposed to and oppositely facing from the primary compartment, the effect of the coolant in the secondary compartment will be equally distributed.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
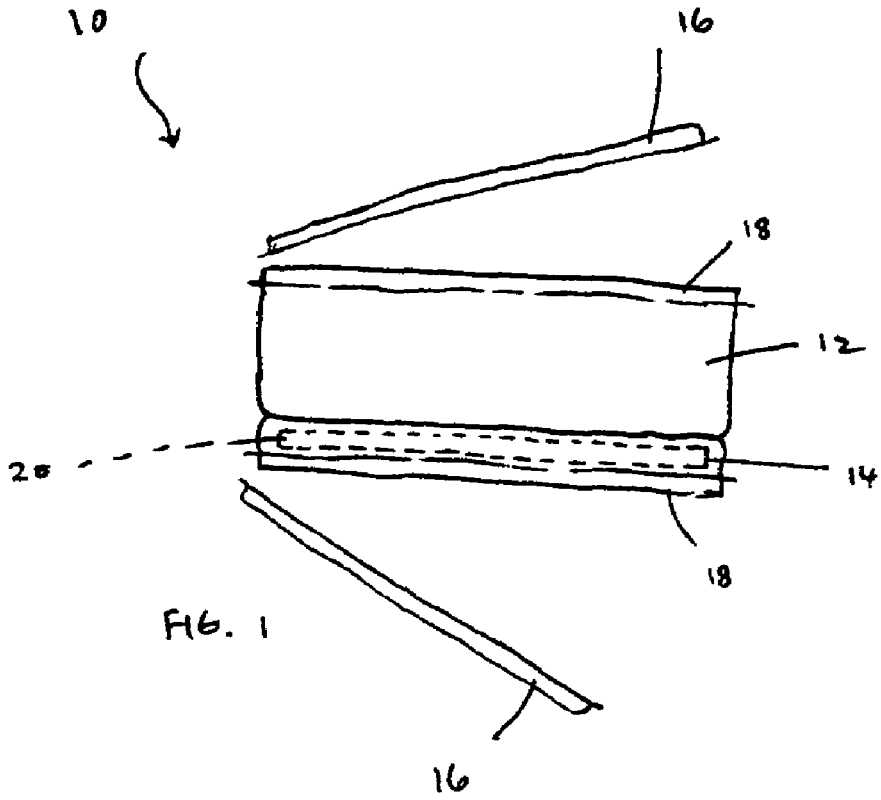
FIG. 1 illustrates a first embodiment container including a primary compartment and a secondary compartment.

FIG. 1 illustrates an exemplary embodiment of the invention. A container 10 includes a primary compartment 12 preferably integrated with a secondary compartment 14. Each compartment is sealable via a lid 16. The lid 16 preferably includes a groove about its perimeter that fits over a corresponding flange 18 on the compartments 12, 14 to define a substantially air tight closure. Of course, other closure assemblies may be utilized, and the invention is not necessarily meant to be limited to the illustrated example.

As shown, the primary compartment 12 is preferably larger than the secondary compartment 14, although the compartment sizes may be varied. The secondary compartment 14 is preferably sized to house a coolant such as an ice pack 20 or the like. The secondary compartment 14 may alternatively be sized to receive ice cubes or some other coolant material. In one arrangement, an ice pack 20 is supplied with the container 10, and a height of the secondary compartment 14 is slightly larger than a thickness of the ice pack 20 in its thickest state. In this manner, the primary compartment 12 is cooled via convection cooling rather than conduction cooling to limit the effect of humidity causing condensation in the primary compartment 12.

With the primary compartment 12 facing upward, the secondary compartment 14 faces downward such that the compartments are generally opposite facing, sharing a compartment bottom panel. Also, a circumference of the secondary compartment 14 substantially corresponds to that of the primary compartment 12 such that the compartments are generally evenly opposed to each other. In this manner, the effect of the coolant 20 in the secondary compartment 14 will be equally distributed in the primary compartment 12.

In an alternative embodiment, the primary compartment 12 and the secondary compartment 14 are manufactured as separate pieces attachable via suitable connecting members on respective facing bottom portions. The connecting members may be molded with the separate pieces to facilitate manufacture.

Figure 2:
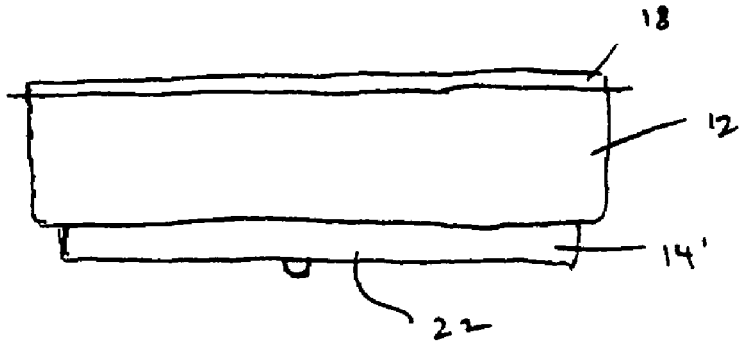
FIGS. 2 and 3 illustrate a second embodiment container including a closing flap.
Figure 3:
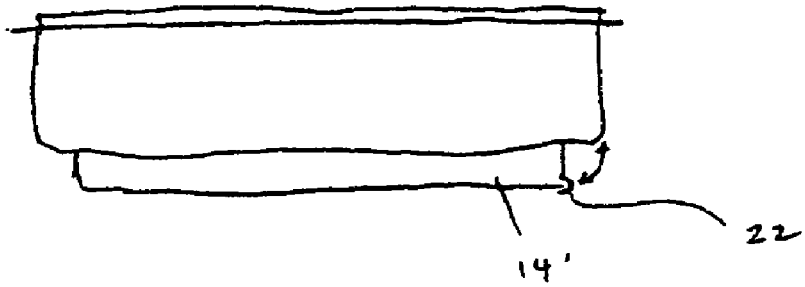

FIGS. 2 and 3 illustrate another embodiment of the invention. In this embodiment, the secondary compartment 14' has an opening along a side thereof, which is sealable via a pivotable flap or door 22.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is :

1. A coolant container kit comprising:

a plurality of containers, each including:

a primary compartment, a secondary compartment generally evenly opposed to and oppositely facing from the primary compartment, and a lid for each of the primary compartment and the secondary compartment; and a plurality of coolant packs, each containing a coolant; the coolant packs being sized to fit in the secondary compartment.

2. A coolant container kit according to claim 1 wherein the container is formed of a disposable material, and wherein the coolant pack is disposable.

3. A container comprising:

a primary compartment including a bottom panel;

a secondary compartment integral with the first compartment and oppositely facing from the primary compartment, wherein the bottom panel of the primary compartment is a top panel of the secondary compartment; and a lid for each of the primary compartment and the secondary compartment.

4. A container comprising:

a primary compartment;

a secondary compartment generally evenly opposed to and oppositely facing from the primary compartment; and a lid for each of the primary compartment and the secondary compartment, wherein the lid of the secondary compartment is removable, wherein the primary compartment is independent of the secondary compartment, and wherein the primary compartment and the secondary compartment comprise connecting structure to connect one to the other.

5. A container according to claim 4 wherein the secondary compartment comprises a coolant pack.

6. A coolant container kit according to claim 1, wherein the primary compartments are independent of the secondary compartments, and wherein the primary compartments and the secondary compartments comprise connecting structure to connect one of the primary compartments to one of the secondary compartments.

7. A coolant container kit according to claim 6, wherein the secondary compartment comprise the coolant pack.

8. A container according to claim 3, wherein the lid of the secondary compartment is removable.

9. A container according to claim 3, wherein the secondary compartment comprises a coolant pack.

* * * * *